United States Patent [19]

Huang et al.

[11] 4,446,348

[45] May 1, 1984

[54] SERPENTINE MICROWAVE APPLICATOR

[75] Inventors: Hua-Feng Huang, Chadds Ford, Pa.; Walter A. Wallace, Wilmington, Del.

[73] Assignee: E. I. Du Pont de Nemours and Company, Wilmington, Del.

[21] Appl. No.: 363,282

[22] Filed: Mar. 29, 1982

[51] Int. Cl.[3] ..... H05B 9/06

[52] U.S. Cl. ..... 219/10.55 A; 219/10.55 R

[58] Field of Search ..... 219/10.55 A, 10.55 F, 219/10.55 M, 10.55 R; 34/1

[56] References Cited

U.S. PATENT DOCUMENTS

| | | | |
|---|---|---|---|
| 3,471,672 | 10/1969 | White | 219/10.55 A |
| 3,711,674 | 1/1973 | Admiraal | 219/10.55 A |
| 3,761,665 | 9/1973 | Nagao et al. | 219/10.55 A |

FOREIGN PATENT DOCUMENTS 1411564 10/1975 United Kingdom .

*Primary Examiner*—Bruce A. Reynolds
*Assistant Examiner*—M. M. Lateef

[57] ABSTRACT

A serpentine microwave applicator for drying aqueous coatings on polymeric webs. Successive waveguides are coupled by enlarged, inverted, rectangular apertures. With such apertures, normal changes in load have minimal adverse effects on energy utilization.

9 Claims, 9 Drawing Figures

FIG. 2
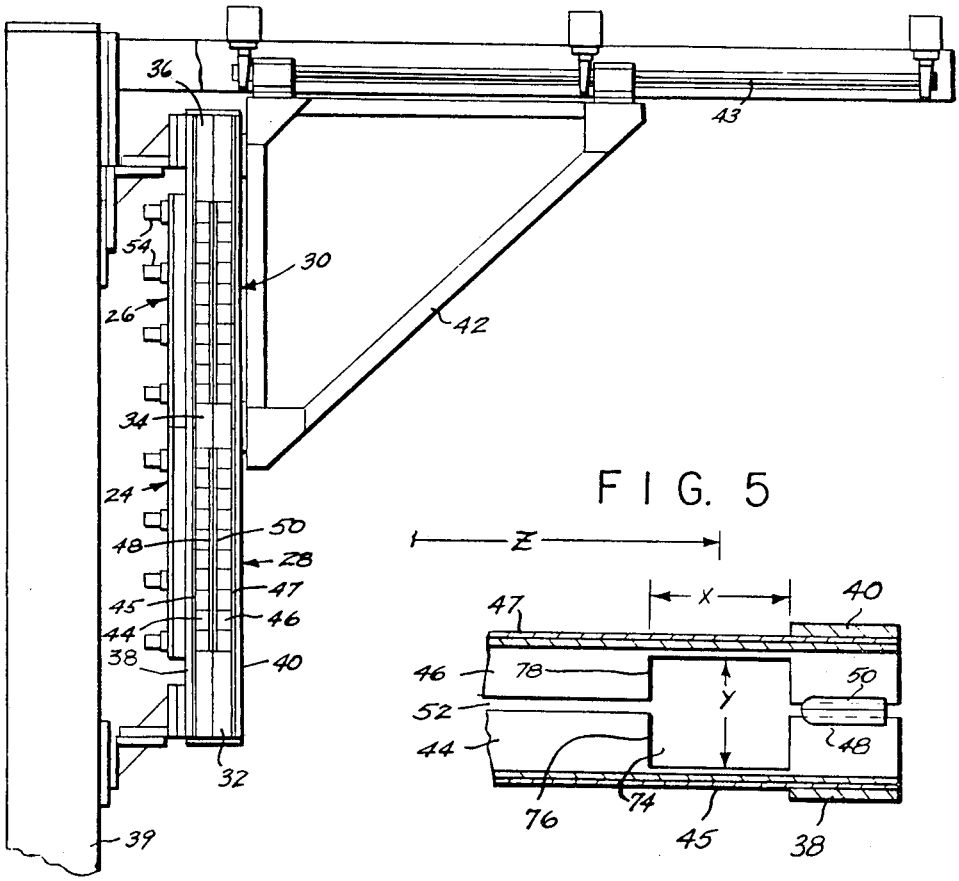
FIG. 5
FIG. 4
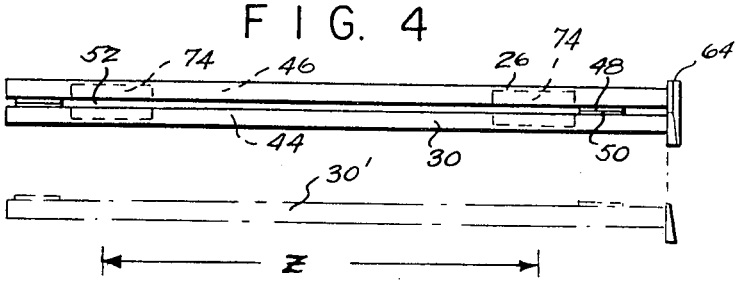

SERPENTINE MICROWAVE APPLICATOR

BACKGROUND

This invention relates generally to the drying of coated webs and, more particularly, to improvements in a microwave applicator of the serpentine type.

It is known in the art that amorphous polymeric webs can be coated with an aqueous dispersion and dried before being biaxially stretched or drawn. According to the disclosure of Pears in Br. 1,411,564, drying may be effected in a hot air oven.

It is also known in the art that various objects can be treated with microwave energy. For example, a serpentine applicator for heating thin sheets of moistened paper is disclosed in U.S. Pat. No. 3,471,672 to White. The applicator has coupling holes between successive waveguides. A particular load can be matched to the source of microwave energy by an adjustment of shorting plates at the ends of the waveguides. However, such an applicator does not remain tuned with varying loads, for example, in the drying of aqueous coatings on wide polymeric webs of different gauges and widths, all of which can be processed at different speeds and receive coatings with different weights and concentrations of additives.

SUMMARY

The principal objective of the present invention is to achieve a much wider bandwidth response in which normal changes in load have little effect on energy utilization in serpentine microwave applicators. That objective has been met in an apparatus having a plurality of slotted waveguides and rectangular coupling apertures between successive waveguides by providing each aperture with a width which is greater than its depth and is also at least half the guided wavelength of the microwave energy.

DRAWINGS

Other objectives and advantages of the present invention will be apparent from the following description wherein reference is made to the accompanying drawings in which:

FIGS. 2 and 3 are side and elevational views of the apparatus;

FIG. 4 is a schematic, plan view of the apparatus, including a phantom illustration of a movable section in its open position;

FIG. 5 is a fragmentary, sectional schematic of a waveguide from one of the microwave applicators shown in FIGS. 1–3;

DESCRIPTION

Figure 1:
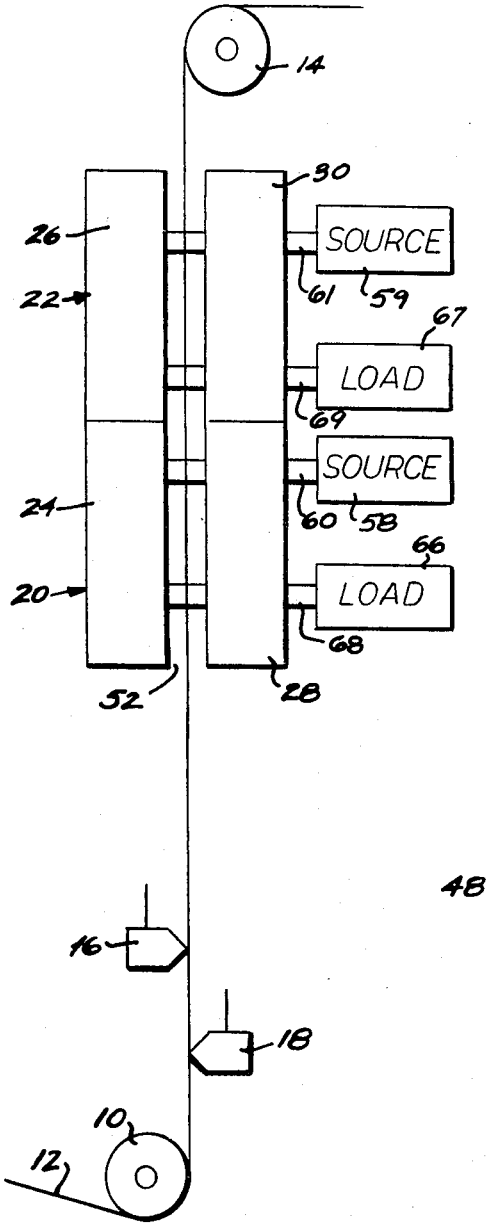
FIG. 1 is a schematic illustration of the apparatus of the present invention and associated elements of the machine into which it has been incorporated.

Referring to FIG. 1, the machine into which the apparatus of this invention has been incorporated includes a roll 10 which receives a freshly extruded, polymeric web 12 from a quenching wheel located near an extrusion die. From roll 10, web 12 advances upwardly to another roll 14 and then to the first of two stations where it is stretched biaxially into a thin film. Between rolls 10, 14, a water-based primer coating is applied to either or both sides of web 12 by elongated dies 16, 18 and the coated web then passes through two, independent, vertically mounted, serpentine applicators 20, 22.

Figure 3:
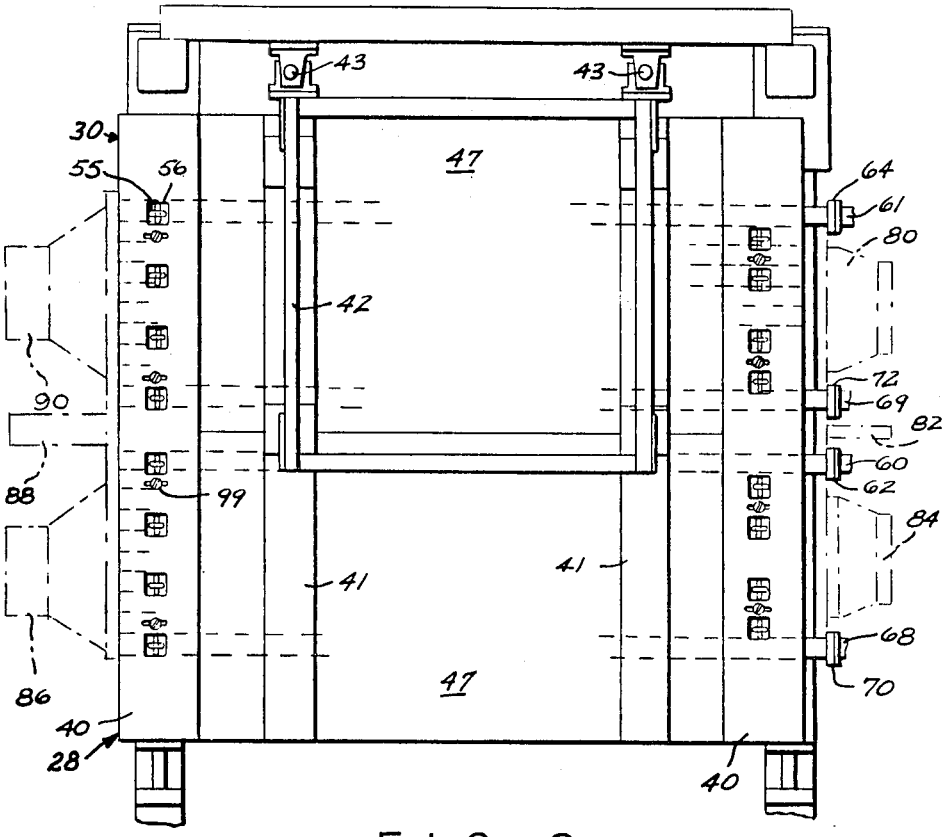

As shown in FIGS. 1–3 the applicators 20, 22 are split into fixed sections 24, 26 and movable sections 28, 30. Sections 24, 26 and filter/choke assemblies 32, 34, 36 (FIG. 2) are attached to clamping plates 38 and the latter are bracketed to spaced posts 39. Sections 28, 30 are attached to clamping plates 40 and vertical bars 41 (FIG. 3). Bars 41 are bracketed to a carriage 42 which is movable on fixed rods 43.

Each of the sections 24, 26 includes a plurality of abutting, aluminum channels 44. Sections 28, 30 have abutting channels 46, each aligned with a channel 44 to present a waveguide. The pluralities of channels 44, 46 are attached to skin plates 45, 47. When applicators 20, 22 are in the closed position, as shown in FIG. 2, channels 44, 46 are separated by elongated, conductive shorting plates 48, 50, leaving a slot 52 (FIGS. 1, 4, 5) which receives web 12 in its advance through the applicators. Plates 48, 50 contact the channels 44, 46 to define short-circuit paths for the electrical field component of the applied microwave energy. The applicators 20, 22 are held in the closed position by locking pins on hydraulic cylinders 54 (FIG. 2). The pins have ends 55 (FIG. 3) which pass through oval slots in steel pads 56 before being turned to their locking positions. The open position of the applicators is shown by phantom lines in FIG. 4.

Microwave energy from separate sources 58, 59 (FIG. 1) is coupled through waveguides 60, 61 joined to applicators 20, 22 by split flanges 62, 64 (FIG. 3) and exits to dissipative loads 66, 67 through waveguides 68, 69 joined to applicators 20, 22 by split flanges 70, 72. The first and last waveguides in each applicator have rectangular, coupling apertures 74 (FIGS. 4 and 5) only at the ends thereof remote from the source and load. All intermediate guides have a coupling aperture 74 at each end thereof. Apertures 74 are defined by rectangular notches 76, 78 adjacent the ends of the legs of channels 44, 46. Notches 76, 78 are in opposite legs at opposite ends of the intermediate channels 44, 46. Thus, coupling apertures 74 along with shorting plates 48, 50 define a serpentine path for microwave energy traveling through the applicators 20, 22.

In FIG. 3, the locations of ducts for the admission and exhaust of venting air are shown in phantom. Air enters ducts 80, 82, 84 which are flanged to section 26 of applicator 22, waffle choke 34 and section 24 of applicator 20, respectively. The air is exhausted through ducts 86, 88, 90.

Figure 6:
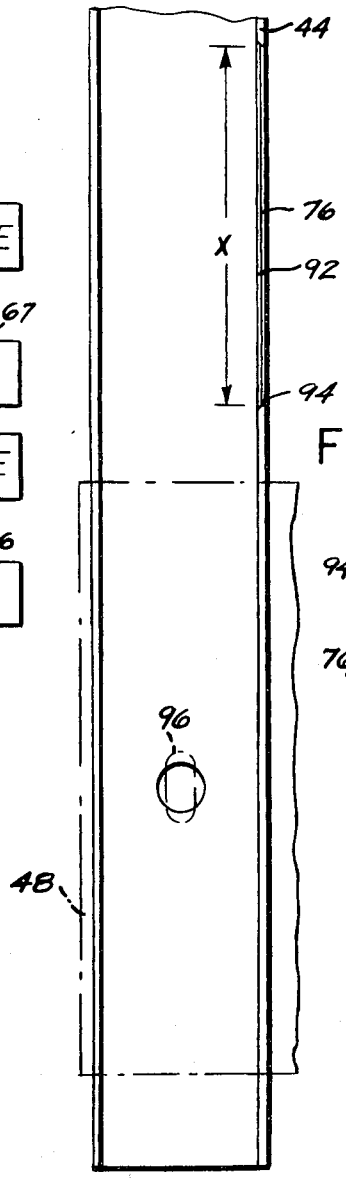
FIGS. 6 and 7 are fragmentary plan and side views, respectively, of one of the channels in each waveguide.
Figure 7:
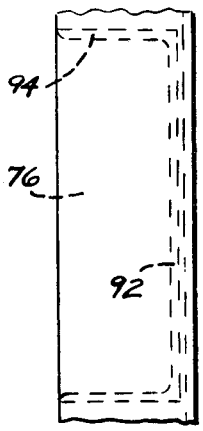

The manner in which the edges of the notches in the legs of the channels are rounded off is shown at 92, 94 in FIGS. 6 and 7. This causes the coupling apertures 74 to behave electrically as though they were slightly larger. A fragment of a shorting plate 48 has been shown in phantom in FIG. 6. Each shorting plate has a number of slots 96 in registry with the through holes for fasteners with which channels 44, 46 are attached to plates 38, 40, 45, 47. From the relationship between slot 96 and the through hole in channel 44, it is apparent that the shorting plate, when adjusted to its innermost position, will be spaced from notch 76, i.e., the shorting plates in applicators 20, 22 are at all times spaced from the coupling apertures 74 (FIG. 5).

Figure 8:
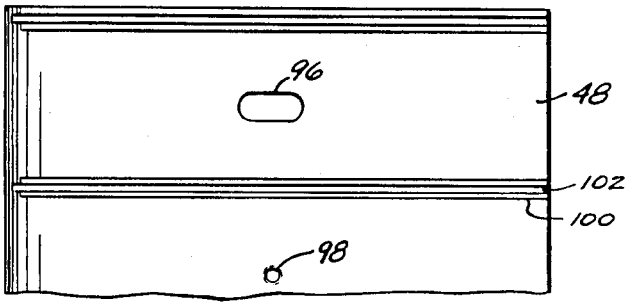
FIG. 8 is a fragmentary, plan view of one of the shorting plates shown in FIGS. 2 and 4–6.
Figure 9:
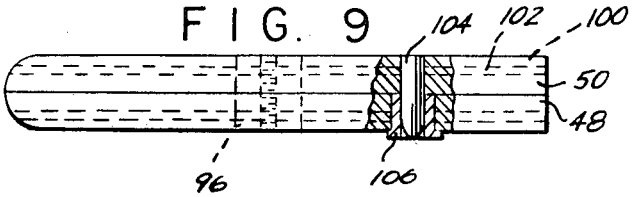
FIG. 9 is an end view of an assembled pair of shorting plates.

Slot 96 also appears in FIGS. 8 and 9, as does a threaded aperture 98 for a screw 99 (FIG. 3) with which the shorting plates are fastened to plates 38, 40. The shorting plates have grooves 100 which receive the legs of channels 44 (or 46) and deeper grooves 102 for metal gaskets which improve the conductivity between the plates and channels. Slotted apertures in plates 38, 40 facilitate adjustments to the extent permitted by the slots 96 in the shorting plates. Two sets of dowel pins 104 and bushings 106 (FIG. 9) are mounted in each pair of shorting plates to maintain alignment.

Referring again to FIG. 5, each coupling aperture 74 has a width X greater than its depth Y. In addition, the width X is at least half the guided wavelength ($\lambda_g$) of the applied energy. Thus, the coupling apertures 74 are not only inverted and enlarged but also have dimensions dependent on and related to the wavelength of the microwave energy from sources 58, 59 (FIG. 1). More particularly, it has been found that the width X should be in the range of $(1.0–1.7)\cdot(\lambda_g/2)$. Incorporation of these features, along with the removal of shorting plates 48, 50 from the apertures 74, provides a much wider bandwidth of response than can be obtained with available serpentine applicators.

If the width X of the coupling apertures is less than $\lambda_g/2$, a narrow bandwidth of response is the result. The maximum bandwidth is limited by the difference between mode frequencies of two successive voltage standing wave ratio (VSWR) spikes. Put differently, the "bandwidth of response" is the difference in frequency between two successive spikes representing standing waves having a VSWR of unacceptable proportions, e.g., greater than 1.5. As noted above, the wide bandwidth of response achieved with the applicators disclosed herein has been attributed to the geometry of apertures 74 and location of shorting plates 48, 50 away from apertures 74. In addition to a wider bandwidth of response, these features have also yielded VSWRs between spikes which are of sufficiently low amplitude to avoid burn patterns in the product being dried.

The bandwidth of response is also affected, to a lesser extent, by the distance Z (FIGS. 4 and 5) between coupling apertures. For a broader bandwidth, Z should be a minimum but must, of course, be sufficient to clear the widest web to be dried. Its actual distance is always an odd multiple of a quarter of the guided wavelength ($\lambda_g/4$).

Once the dimensions X and Z have been determined, a condition of nonresonance in each coupling between waveguide passes is insured. At each aperture, a number of radiating modes is produced, one of which has the proper phase relationship for reflection into the next pass. Thus, as the wavelength of the propagating energy in the slotted section adjusts to dielectric changes in the product, a radiating mode in the aperture is present to reflect a significant portion of the energy to the next pass.

A factor of primary importance in the operation of the applicators of the present invention is the dimension Y (FIG. 5). Once the dimensions X, Z and the approximate location of the shorting plates for a wide bandwidth of response are set, the dimension Y is selected to center $\lambda_g$ in the bandwidth of response. Thus, exposure of the product being dried to VSWR of unacceptable proportions is avoided in spite of slight changes in tuning from pass-to-pass or variations in the product. In these respects, it has been found that the ratio of X/Y falls within the range of 1.2–1.5.

As a final step in preparing the applicator for use, the shorting plates are adjusted symmetrically, using a vernier scale, for a broadband impedance match covering the full product range of the machine into which it is installed.

In an embodiment that has been built and installed, the sources 58, 59 are klystron tubes (Thomson TH 2075, Thomson CSF, Paris, France) operated up to 50 kilowatts (kw) at a center frequency of 2.450±0.0050 gigahertz (GHz). Dissipative loads 66, 67 are water loads (Microwave Technology Model 2550 WR 430, 50 kw Water Load). WR 430 waveguides are used to couple the applicators to sources 58, 59 and loads 66, 67. The split waveguides in applicators 20, 22 were fabricated from high conductivity 6063-T5 aluminum channels with internal dimensions of 4.30 inches and 2.15 inches (WR 430). The apertures 74 have X, Y dimensions of 4.73 and 3.87 inches, respectively. The material for shorting plates 48, 50 is also aluminum and these plates are spaced 0.73–1.85 inches from apertures 74. The distance Z is 59.64 inches and depth of slot 52 is 0.75 inch.

In operation, a quenched polyester web 12 advances under roll 10, past dies 16, 18, through slot 52 and over roll 14 to the first of two stretching stations. An aqueous primer coating is applied to either or both sides of the web by the dies 16, 18 and that coating is dried as the web passes through applicators 20, 22. In preliminary tests, the apparatus has operated effectively over a wide range of gauges for the web. Put differently, the applicators remain coupled to the sources and operate at an acceptable VSWR over a range of coatings, gauges and widths. In this respect, a VSWR of less than 1.5 is deemed acceptable. Additionally, the coatings are dried, at normal line speeds, without raising the temperature of the amorphous, unoriented web to its glass transition point.

What is claimed as new and desired to be secured by Letters Patent is:

1. In a serpentine microwave applicator having a plurality of slotted waveguides and rectangular apertures between the waveguides for coupling them, the improvement comprising providing each aperture with a width greater than its depth and at least half the guided wavelength of the applied energy.

2. The applicator of claim 1 wherein the center-to-center distance between coupling apertures is an odd multiple of quarter guided wavelengths.

3. The applicator of claim 2 further comprising elongated shorting plates traversing said waveguides adjacent each end thereof, said plates being located between and spaced from the ends of the waveguides and said coupling apertures.

4. The applicator of claim 3 wherein the ratio of width to depth is in the range of 1.2–1.5.

5. The applicator of claim 4 wherein the width of each coupling aperture is in the range of 1.0–1.7 times half the guided wavelength.

6. In a serpentine microwave applicator including a plurality of slotted waveguides having rectangular coupling apertures therebetween and elongated shorting plates traversing the waveguides adjacent each end thereof, the improvement comprising providing each aperture with a width greater than its depth and at least half the guided wavelength of the applied energy, said plates being located between and spaced from the ends of the waveguides and said coupling apertures.

7. The applicator of claim 6 wherein the width of each coupling aperture is in the range of 1.0–1.7 times half the guided wavelength.

8. The applicator of claim 7 wherein the ratio of width to depth is in the range of 1.2–1.5.

9. The applicator of claim 8 wherein the center-to-center distance between coupling apertures is an odd multiple of quarter guided wavelengths.

* * * * *